US007520280B2

(12) United States Patent
Gordon

(10) Patent No.: US 7,520,280 B2
(45) Date of Patent: Apr. 21, 2009

(54) REBREATHER APPARATUS

(76) Inventor: William Gordon, 11517 N. Park Ave. N., Seattle, WA (US) 98133

( * ) Notice: Subject to any disclaimer, the term of this patent is extended or adjusted under 35 U.S.C. 154(b) by 818 days.

(21) Appl. No.: 10/821,065

(22) Filed: Apr. 8, 2004

(65) Prior Publication Data

US 2004/0200478 A1 Oct. 14, 2004

Related U.S. Application Data

(60) Provisional application No. 60/461,046, filed on Apr. 8, 2003.

(51) Int. Cl.

| | |
|---|---|
| ***A62B 7/10*** | (2006.01) |
| ***A62B 19/00*** | (2006.01) |
| ***A62D 9/00*** | (2006.01) |
| ***B63C 11/18*** | (2006.01) |

(52) U.S. Cl. ..... 128/205.28; 128/201.25; 128/201.26; 128/201.27; 128/200.29; 128/205.22; 55/486; 55/487

(58) Field of Classification Search ..... 128/201.22, 128/201.23, 201.25, 201.27, 201.28, 201.29, 128/202.11, 205.17, 205.22, 205.23, 205.27, 128/205.28, 206.17; 55/486, 487
See application file for complete search history.

(56) References Cited

U.S. PATENT DOCUMENTS

| | | | | | |
|---|---|---|---|---|---|
| 2,731,709 | A | | 1/1956 | Gaddis et al. | |
| 3,021,839 | A | * | 2/1962 | Marsh | 128/204.28 |
| 3,326,212 | A | * | 6/1967 | Phillips | 128/201.21 |
| 3,403,981 | A | * | 10/1968 | Lemcke et al. | 422/120 |
| 3,556,098 | A | * | 1/1971 | Kanwisher et al. | 128/202.22 |
| 3,773,044 | A | * | 11/1973 | Wallace | 128/202.22 |
| 3,923,053 | A | * | 12/1975 | Jansson | 128/205.12 |
| 3,957,043 | A | | 5/1976 | Shelby | 128/142 G |
| 4,193,966 | A | | 3/1980 | Dowgul | 422/122 |
| 4,294,242 | A | * | 10/1981 | Cowans | 128/201.13 |
| 4,350,662 | A | | 9/1982 | Dowgul et al. | 422/122 |
| 4,409,978 | A | * | 10/1983 | Bartos | 128/205.12 |
| 4,440,165 | A | * | 4/1984 | Holzel | 128/205.28 |
| 4,515,156 | A | * | 5/1985 | Khudosovtsev et al. | 128/202.26 |
| 4,781,184 | A | | 11/1988 | Fife | 128/205.12 |
| 5,036,841 | A | | 8/1991 | Hamilton | 128/202.26 |

(Continued)

FOREIGN PATENT DOCUMENTS

| | | | |
|---|---|---|---|
| WO | WO 9907442 | A2 * | 2/1999 |

*Primary Examiner*—Justine R Yu
*Assistant Examiner*—Clinton Ostrup
(74) *Attorney, Agent, or Firm*—Christensen O'Connor Johnson Kindness PLLC

(57) ABSTRACT

A rebreather apparatus having a gas scrubber canister with a generally oval or elliptical cross section. The canister being configured so that exhaled gases pass through the adsorbent in a radial manner through a generally hollow tube having the same cross sectional shape as the canister. The shape of the canister allows for increasing the volume of the canister relative to round cylinder shaped canisters without making it too cumbersome such that it effects the efficiency of a diver. The canisters have at least one removable end cap and the end caps are configured for housing gas addition and control systems. The rebreather apparatus can be rapidly reconfigured to provide a variety of fully closed or semi closed circuit configurations and it can be reconfigured to be worn in a variety of ways based on tasks to be performed and diver preference.

28 Claims, 5 Drawing Sheets

U.S. PATENT DOCUMENTS

| | | | | |
|---|---|---|---|---|
| 5,195,516 | A | 3/1993 | Grimsey | 128/204.26 |
| 5,291,881 | A | 3/1994 | Drews et al. | 128/205.27 |
| 5,924,418 | A | 7/1999 | Lewis | 128/204.22 |
| 5,964,221 | A | 10/1999 | McKenna | 128/205.12 |
| 6,003,513 | A * | 12/1999 | Readey et al. | 128/205.24 |
| 6,302,106 | B1 | 10/2001 | Lewis | 128/204.22 |
| 7,089,933 | B2 * | 8/2006 | Goldblatt et al. | 128/203.12 |
| 2001/0015203 | A1 | 8/2001 | Cumming | 182/204.26 |
| 2003/0188745 | A1 | 10/2003 | Deas et al. | 128/201.27 |

* cited by examiner

REBREATHER APPARATUS

CROSS REFERENCE TO RELATED APPLICATION

This application claims priority from U.S. Provisional Patent Application No. 60/461,046 entitled "CANISTER FOR A RE-BREATHING APPARATUS," filed Apr. 8, 2003.

TECHNICAL FIELD

The present application relates to a rebreather apparatus used for underwater diving, and more particularly to a rebreather apparatus having an elongated canister with a generally oval or elliptical shaped cross section, the canister being used to hold an adsorbent material for removing carbon dioxide from expelled air in the rebreather apparatus, the expelled air traveling radially through the adsorbent material before exiting the canister.

BACKGROUND OF THE INVENTION

In its simplest form a re-breather is a device that enables a person to retain and reuse some or all of his or her expired breath. Even with physical exertion, a person uses only a fraction of the oxygen that is inhaled. A re-breather re-circulates unused oxygen in the system and replenishes the oxygen as it is used by the wearer. This allows a very small tank of oxygen to last much longer than is possible using traditional SCUBA (Self Contained Underwater Breathing Apparatus) gear. The three main components of typical re-breather systems are gas supply/oxygen control, counterlung, and carbon dioxide removal system.

A rebreather has a carbon dioxide removal system that maintains $CO_2$ pressures at a safe level. This is relatively easy to do, and is accomplished by passing exhaled gases through a canister filled with a chemical adsorbent, such as soda lime. Several manufacturers make these adsorbents and use their own special mixes. For example, SODASORB®, manufactured by W. R. Grace & Co., consists of a mixture of sodium hydroxide, calcium hydroxide and potassium hydroxide. Other adsorbents, such as lithium hydroxide, can be used to offer improved cold water performance.

Adsorbents are typically in the form of small granules 0.04 to 0.25 inches (1.0 to 6.5 mm) in diameter, placed in a canister through which exhaled gases are passed. Smaller granules allow more surface area per unit weight, but because the person must "breathe" through this canister without too much resistance, larger adsorbent particles are employed so as to allow gas flow around these granules, and through the canister with a relatively low pressure drop.

Current re-breathers employ canisters that are generally cylindrical in shape and the expelled gas enters the canister through one end of the cylinder and exits at the opposite end. In the past, the design of $CO_2$ removal canisters has been limited to one of three general configurations decided at the time of manufacture. In the Axial Configuration, expelled gases pass directly from one end of the canister to the other through the adsorbent material. In one radial configuration, the expelled gas flows from a tube in the center of the canister and radiates outward through the adsorbent material. Another radial configuration comprises of expelled gases entering the canister and flowing from the outside of the adsorbent material and radiating inward through the adsorbent material.

Because the larger particles of adsorbent material cannot be packed into the canister as densely as the smaller particles, if one desires to increase the available $CO_2$ adsorption capacity of a re-breather one must add additional adsorbents. To increase the volume of adsorption material, one must increase the volume of the canister. In the case of canisters having the radial configuration, any increase in canister volume would be due to an increase in the diameter of the cylinder and/or the length of the cylinder. Any significant increase in cylinder volume could potentially result in a cylinder having a diameter and/or length that would be overly cumbersome and impractical for diving because while a diver was able to stay down longer, he or she would not be able to work as efficiently due to the canister size and/or placement of the canister on the diver's body.

DISCLOSURE OF THE INVENTION

One object of this disclosure is to provide a rebreather apparatus having a gas scrubber canister that is less cumbersome and provides a lower profile on a diver's body than scrubber canister with a round cross sectional shape that has an equivalent amount of scrubbing medium in the canister.

An additional object of this disclosure is to provide a rebreather apparatus wherein various components of the apparatus can be easily replaced, and wherein the same components of the apparatus can be worn on front or back of a diver's body in a variety of configurations.

As used throughout this document, the terms "gas scrubbing medium" and "adsorbent material" both indicate a material used to remove unwanted molecules from gases by capturing the molecules in the material, and should be assumed to be interchangeable throughout this document.

Disclosed herein is a rebreather having a scrubber canister with an elliptical cross section or an oval cross section. The canister can be configured to allow exhaled gases to flow through the scrubbing medium either axially, from one end of the scrubber canister to the other end, or radially, from the outside edge of the scrubbing medium to the middle or from the center outward. However, the disclosure herein focuses on such a canister having radial flow. In the single radial flow configuration, the tube in the interior of the canister has the same cross sectional shape of the canister. The canister can also be configured to have a plurality of tubes for expelled gases.

Also disclosed herein are removable end caps for the canisters. The end caps are configured to provide space for gas pressure monitoring and control systems that are used with rebreathers. Some canisters have removable end caps on one end while other canisters can be configured with only one removable end cap.

The end caps of the two end cap canisters can be configured such that each end cap includes a monitoring and control system or that only one end cap has such a system. Where each end cap has a monitoring and control system, the systems can be redundant, i.e., two systems for a fully closed circuit, or the two systems can be different, i.e., one system for a fully closed circuit and a system for a partially closed circuit.

Also disclosed herein is a rebreather apparatus having components that can be configured in multiple variations and worn in a variety of locations on a divers body

BRIEF DESCRIPTION OF THE DRAWINGS

The several objectives and features of the apparatus disclosed herein will become more readily apparent from the following detailed description taken in conjunction with the accompanying drawings in which.

BEST MODE OF CARRYING OUT THE INVENTION

Figure 1:
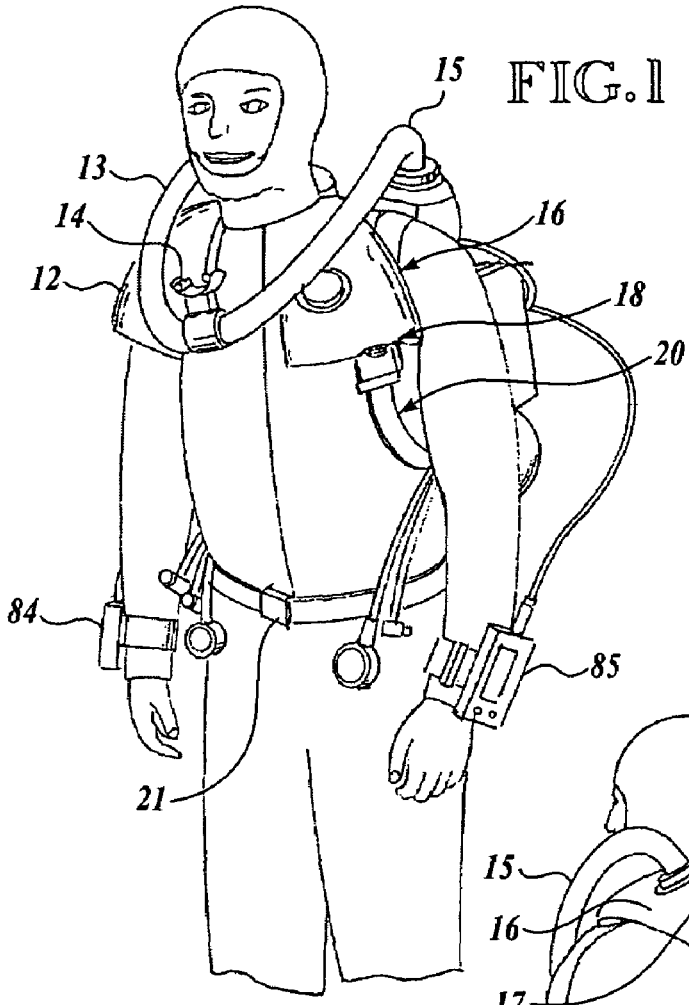
FIG. 1 shows the front of a diver wearing one configuration of the rebreather apparatus disclosed herein.
Figure 2:
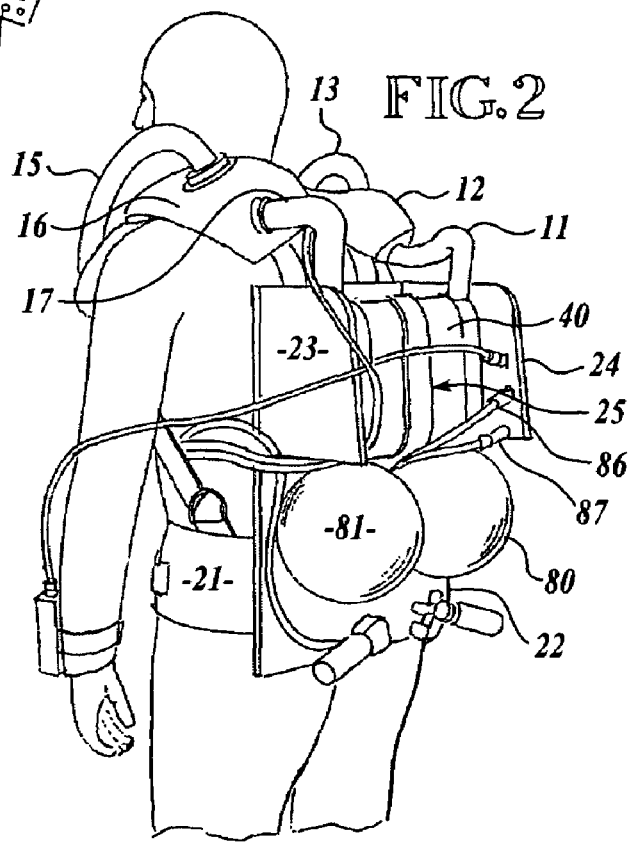
FIG. 2 shows the back of a diver wearing one configuration of the rebreather apparatus disclosed herein.

Turning now to the drawings, the invention will be described in preferred embodiments by reference to the numerals of the drawing figures wherein like numbers indicate like parts. FIG. 1 and FIG. 2 show a diver wearing a rebreather apparatus as disclosed herein from the front and back respectively. The rebreather has a gas supply circuit, with an inhalation portion, an exhalation portion, and a mouthpiece. The inhalation portion has two gas carrying conduits 11, 13 and a counterlung 12. The exhalation portion also has two gas carrying conduits 15, 17, and a counter lung 16. The counterlungs 12, 16 are made from a flexible material such that the counterlungs can expand and collapse based on the volume of gas in the counterlungs. The counterlung 12 in the inhalation portion of the circuit can have either a manual gas addition valve or an automatic gas addition valve so that gas can be added to the counter lung as needed. The counterlung 16 in the exhalation portion of the circuit has a valve 18 that allows gas to be released from the supply circuit as necessary.

A mouthpiece 14 is connected to the gas-carrying conduit 13 in the inhalation portion and the gas-carrying conduit 15 of the exhalation portion. The mouthpiece 14 is configured with valves so that a diver can inhale and receive gases from only the inhalation portion of the circuit, and the exhaled gases enter only the exhalation portion of the circuit.

The gas carrying conduits on the exhalation portion of the circuit 17 and the inhalation portion of the circuit 11 are connected to a scrubber canister 40 that contains a medium for removing carbon dioxide from the air exhaled by a user. As will be explained in more detail below, the scrubber canister has a pair of removable end caps that are configured so that the sensor and control systems for the gas monitoring and addition devices can be placed in the end caps.

In the embodiment pictured, compressed oxygen is provided from a tank 80 into the circuit via a compressed gas conduit 86, and a breathable combination of oxygen and inert gases known as a diluent is provided to the system via a compressed gas conduit 87. For the pictured embodiment, a primary computer 85 is worn on the diver's left wrist and a secondary computer 84 is worn on the right wrist. The computers are connected to the control device in the end cap of the scrubber canister by cables. Located near the diver's left hip is a pressure gauge for the diluent container 81 and a switch for manual addition of diluent into the circuit. Located near the diver's right hip is a pressure gauge for the oxygen container 80 and a switch for manual addition of oxygen into the system.

The components of the rebreather are made so that they can be worn in a variety of configurations on a divers body. In the embodiment shown in FIGS. 1 and 2, the apparatus is worn in a manner similar to a backpack with the scrubber canister oriented horizontally relative to the diver. The shoulder straps 20 are routed through a shoulder strap loop on the underside of the counter lungs 12 & 16 and attached to the waist belt 21. The shoulder straps 20 and waist belt 21 are attached to the back plate 22 and the components of the apparatus are attached to the back plate. The scrubber canister 40 is placed on the back plate such that the ends of the scrubber canister are adjacent to the side plates 23 & 24 on the upper portion of the back plate. The canister is then secured to the back plate by a strap 25 that is attached to the back plate.

Figure 3:
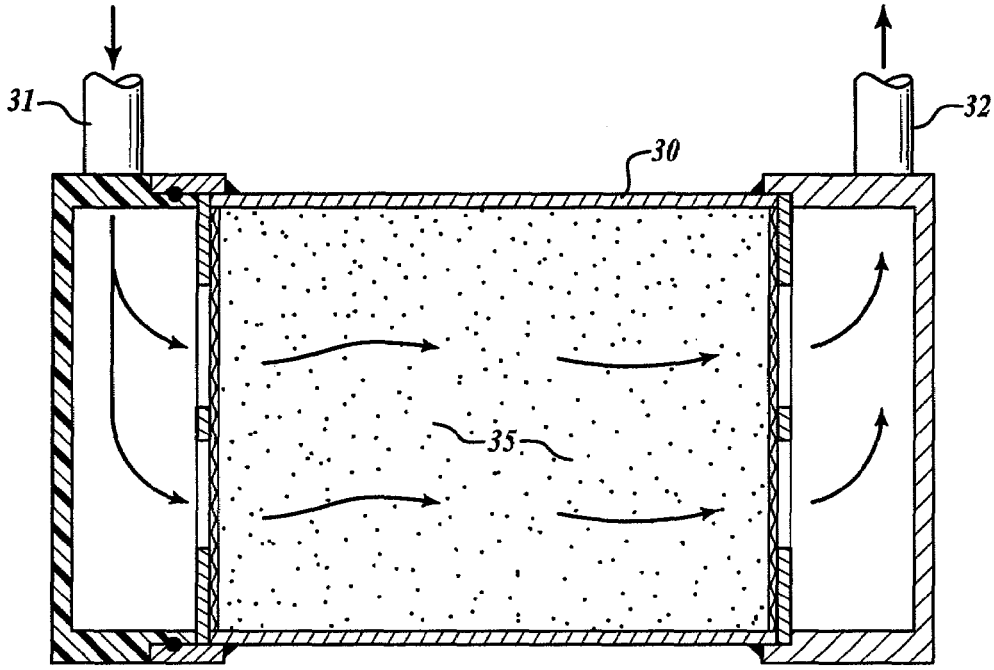
FIG.3 (PRIOR ART)
FIG. 3 is a cross sectional view of one type of round axial flow scrubber canister having as commonly used by currently known rebreather apparatuses.

Referring now to FIG. 3 there is shown an axial cross section of a gas scrubber canister of the prior art. The canister 30 is a round cylinder having a gas scrubbing medium 35. Exhaled air enters the canister at one end 31, passes axially through the scrubbing medium and exits the canister at the other end 32. As the air passes through the scrubber medium, unwanted elemental molecules, usually carbon dioxide, adhere to the scrubbing medium.

Figure 4:
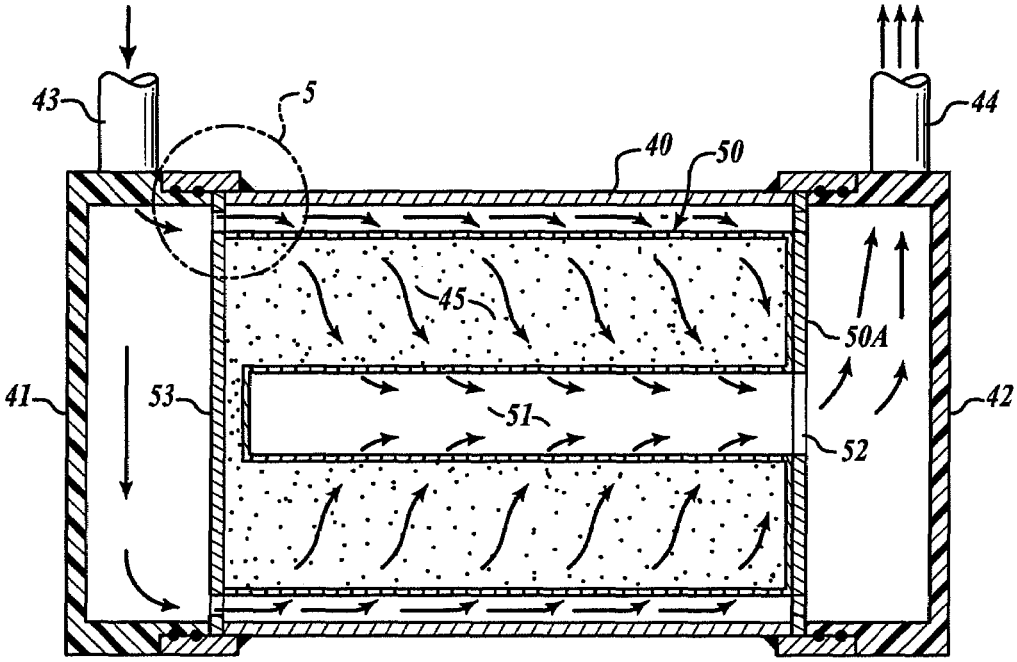
FIG. 4 is a cross sectional view of an oval radial flow scrubber canister used in at least one configuration of the rebreather apparatus disclosed herein.
Figure 5:
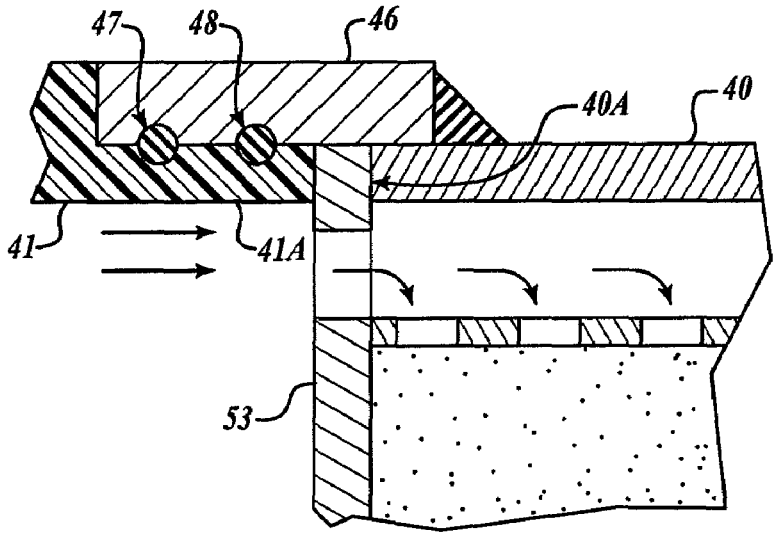
FIG. 5 is a more detailed view of the seal between the end cap and the scrubber canister of the rebreather apparatus disclosed herein.
Figure 6:
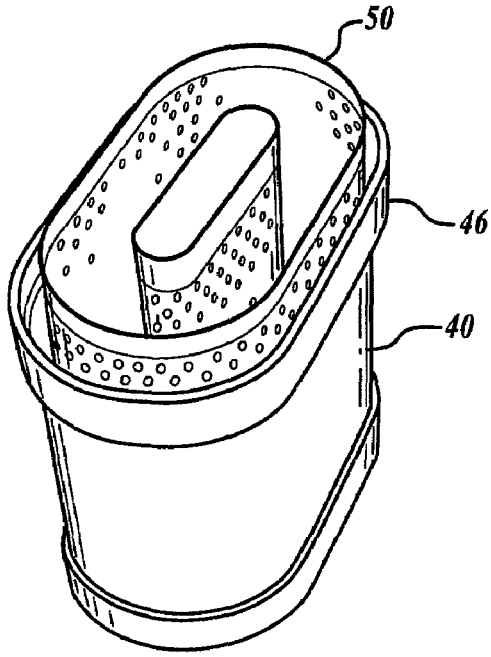
FIG. 6 is an elevated perspective view of a scrubber canister for the rebreather apparatus disclosed herein.

An embodiment of the gas scrubber canister for the rebreather apparatus disclosed herein is shown in FIG. 4 through FIG. 6. The canister 40 is generally oval shaped and has removable end caps 41 and 42. In the embodiment depicted, end cap connection portion (shown as 41 A in FIG. 5) is inserted into the connecting end portion 46 of the scrubber canister. The connecting end portion having the same shape as the canister but being slightly larger that the canister. The end cap can be secured to the canister in a variety of ways. In the embodiment depicted in FIG. 2, the side plates keep the end caps on the scrubber. In other embodiments, other fastening means are used, including at least bolts, screws, latches, and straps. In one embodiment, the end caps are secured to the scrubber canister by friction and the pressure of water surrounding a diver.

As can be seen in FIG. 5, a pair of flexible O-rings 47 & 48 create a water tight seal between the end caps (41 in FIG. 5) and the canister 40. In the embodiment depicted, the rings are on the end caps, but other embodiments have the rings in the connecting end portion of the canister. At least one embodiment of the rebreather includes grooves for the O-rings in the component that does not have the O-rings mounted on it. The connection is essentially water tight because two O-rings provides a level of redundancy in case water gets past the first O-ring. Additionally, the gas trapped between the O-rings, when the end cap is placed on the canister, remains at one atmosphere when a diver is at depth and this difference in pressures assists in creating the water tight seal.

The depicted embodiment includes a removable insert 50 that is secured in the canister 40 for holding the scrubbing medium 45. The walls of the insert include a plurality of openings communicating therethrough so that gas can pass through the insert walls. The insert has the same shape as the scrubber canister, and is made so that it creates a hollow tube 51 in the approximate center thereof. The hollow tube also has the same shape as the scrubber canister, such that the space between the outer wall of the insert and the portion of the insert defining the tube 51 is generally uniform.

FIG. 4 shows that the insert 52 of the depicted embodiment was inserted into the end of the scrubber canister that is on the right side of the canister as depicted. The insert can be inserted into either end of the canister. The insert has a flanged bottom plate 50A that rests against the lip (shown as 40A in FIG. 5) at the interior end of the connecting end portion. The insert can be secured in the canister by a variety of devices including screws, snap clips or spring-loaded latches. In at least one embodiment, the insert is secured into the canister by an adhesive. Additionally, one can see in FIGS. 4 & 5 that the flanged bottom plate 50A and the insert lid 53 are secured between the end cap wall and the raised lip portion (shown as 40A and 41A in FIG. 5).

When the insert 50 is secured in the canister 40, there is a uniform space between the canister wall and the insert. As seen in FIG. 6, the hollow tubes of at least one embodiment of the rebreather apparatus disclosed herein have an interior end that is configured to prevent gases from entering the end of the tube that is opposite the bottom open end.

In the embodiment depicted the scrubbing medium 45 is placed into the insert 50, and an insert lid 53 is secured in the canister 40. The canister is connected to the gas supply circuit and exhaled gases enter the canister through the gas tube 43 on one of the end caps 41. The insert lid prevents gasses from entering the scrubbing medium axially, but has a plurality of holes around the exterior edge there of for allowing the gasses to flow into the space between the insert and the canister wall. The gases then enter the scrubbing medium and move radially through the medium and into the hollow tube 51, passing through the holes in the insert walls to enter and exit the scrubbing medium. The gases then exit the hollow tube at the end of the insert having the bottom plate 50A. The gases then enter the circuit through the gas tube 44 on the other end cap 42. As the gases pass through the scrubbing medium carbon dioxide molecules adhere to the scrubbing medium.

The scrubbing medium can be replaced after it becomes saturated with carbon dioxide. The medium can also be replaced based on time of use of the apparatus or any other desired criteria. However, the medium cannot be replaced while the apparatus is being used.

Figure 7:
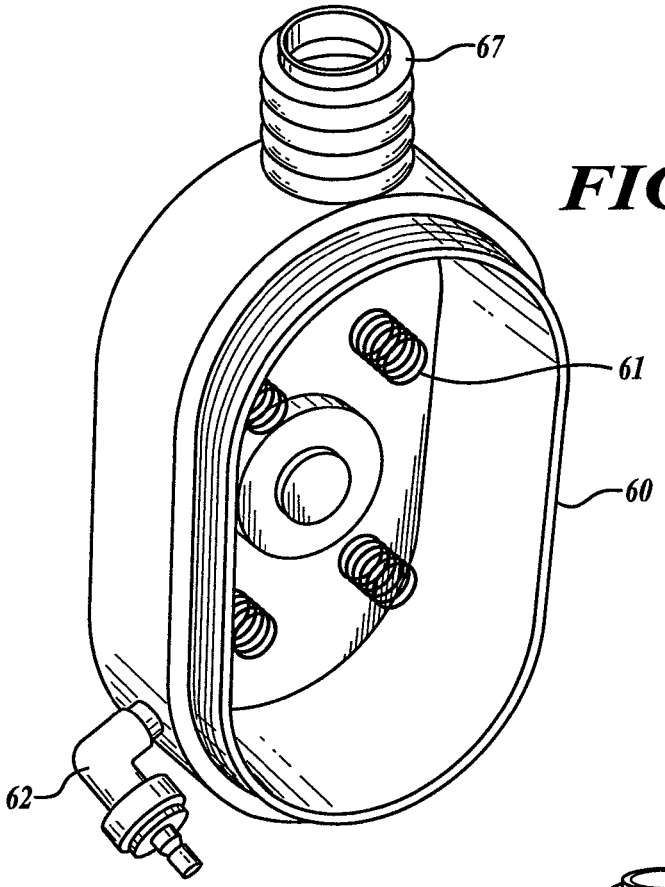
FIG. 7 and FIG. 8 show two different embodiments for the end caps of the scrubber canister for the rebreather apparatus disclosed herein.
Figure 8:
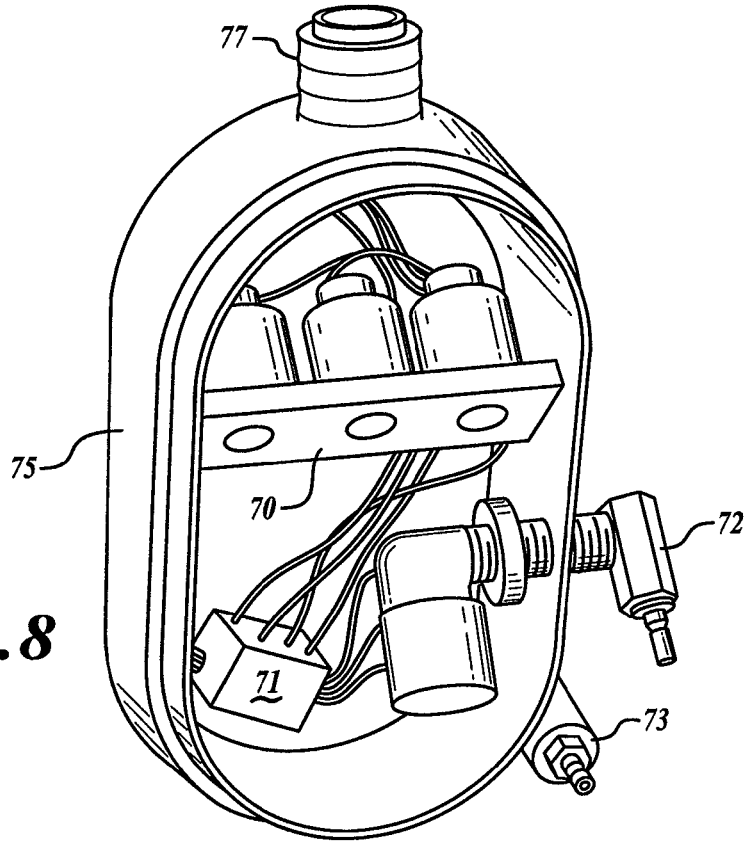

As noted above, the end caps of the rebreather apparatus disclosed herein are made so that the sensing and control systems can be secured inside the end caps. FIG. 7 and FIG. 8 are two examples of possible end cap configurations. The end cap 41 in FIG. 7 includes springs 61 that are used to assist in securing the insert lid in place, and gas connection 62. The connection 62 could be used for manual addition of oxygen if the rebreather apparatus were set up to be a fully closed circuit. The cap is connected to the supply circuit via a gas-carrying conduit 67 that is attached to the gas tube on the end cap.

The end cap 75 in FIG. 8 includes sensors and control devices 70 & 71 for a control system and there is a gas connection 72 and gas connection 73. The gas connections could be used for automatic addition of oxygen and/or diluent to the system. The cap is connected to the supply circuit via a gas-carrying conduit 77 that is attached to the gas tube on the end cap. The removable end caps can be easily replaced to reconfigure the rebreather apparatus and the use of removable end caps allows the caps to be changed from either end of the canister. Additionally, two independent and/or redundant gas addition and monitoring systems can be placed in the canister, one at each end. Examples of systems that can be used are any combination of manual addition, semi closed, fully closed, secondary, passive addition, or demand.

Figure 9:
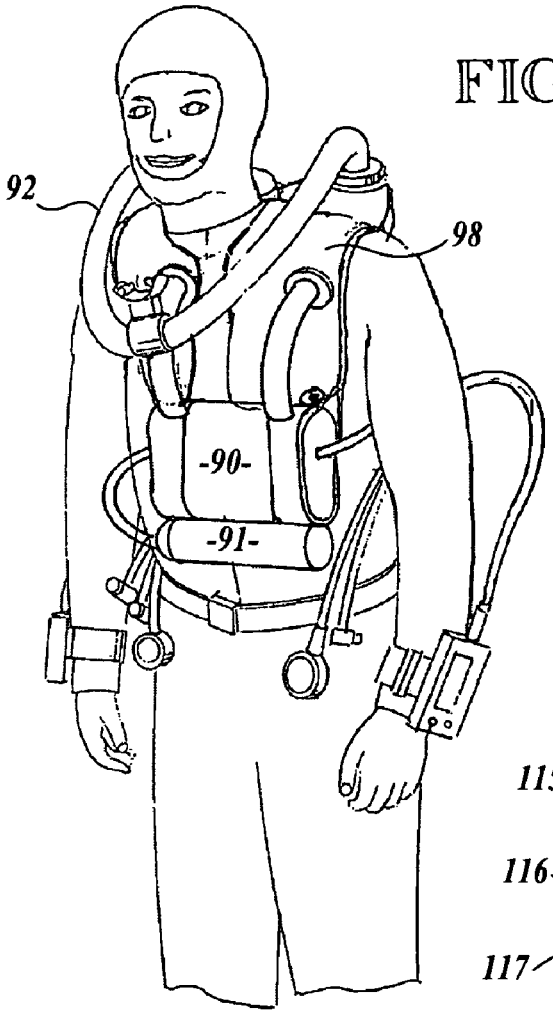
FIG. 9 and FIG. 10 show two different configurations of the rebreather apparatus disclosed herein.
Figure 10:
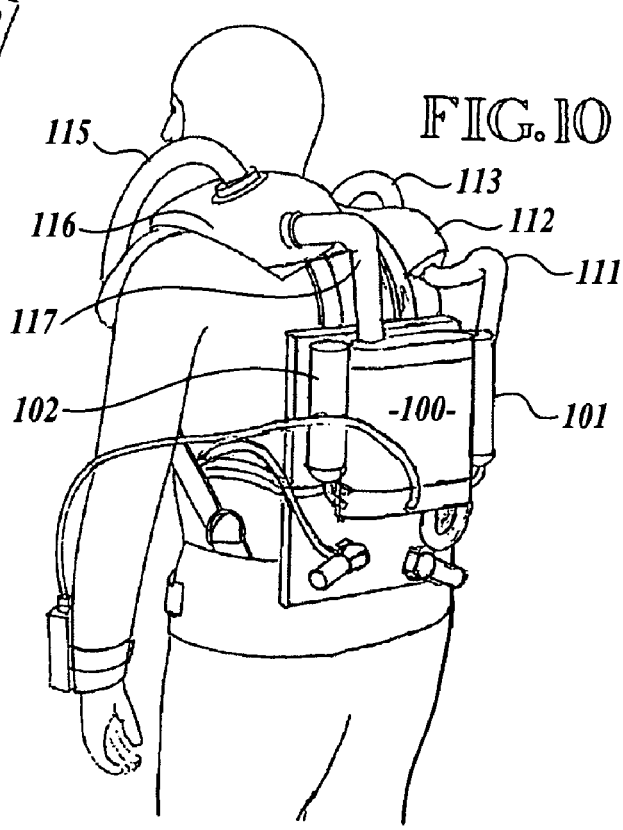

FIG. 9 shows the rebreather apparatus disclosed herein as it is configured to be worn differently than worn by the diver in FIGS. 1 & 2. The canister 90 is secured to a harness such that a diver can wear the canister on the front of the divers body. The counterlungs 92 and 98 are attached to shoulder straps. In the embodiment depicted the apparatus has only one container of compressed gas 91, but other embodiments can include an additional container of compressed gas. FIG. 10 shows yet anther embodiment of the rebreather apparatus, including an inhalation portion having two gas-carrying conduits 111, 113 and a counterlung 112. An exhalation portion also has two gas-carrying conduits 115, 117, and a counter lung 116. The canister 100 may be secured to the back of the divers body, with two containers of compressed gas 101 and 102 on either side of the canister 100.

While not depicted in the drawings, another embodiment of the apparatus is configured so that the canister is worn on the diver's back in a vertical orientation to the diver such that one end of the canister faces the divers head and the other end faces the feet. Other canister embodiments include only one removable end cap. At least one embodiment includes a canister with only one removable end cap worn in a vertical manner on the divers back as described above.

The shape of the canister allows for canisters with increased volume, relative to current canisters, while still keeping the canister at a manageable size for diver comfort and efficiency. The canister can be reconfigured from single radial, and multiple radial based on diver preference and the task to be performed. Gases can flow through the canister in either direction.

The use of removable end caps allows the insert to be changed from either end of the canister. Additionally, two independent and/or redundant gas addition and monitoring systems can be placed in the canister, one at each end. Examples of systems that can be used are any combination of manual addition, semi closed, fully closed, secondary, passive addition, or demand.

The canisters disclosed in the current invention can be mounted on the front or back of the diver, depending on the task to be performed and the diver's preference in configuring the rebreather apparatus. Several different examples can be seen in the sketches accompanying this document.

INDUSTRIAL APPLICABILITY

The disclosure herein describes a rebreather apparatus having a canister, for holding chemical adsorbents, that has a generally oval or elliptical cross section. Gases flow radially through the canister and canisters all have at least one removable end cap with some canisters having two removable end caps. The end caps are configured for housing gas addition and control systems. The rebreather apparatus can be rapidly reconfigured to provide a variety of fully closed or semi closed configurations that can be worn in a variety of ways based on tasks and diver preference. The apparatus has applicability in the field of rebreathers for scuba diving in recreational, commercial, and military applications.

What is claimed is:

1. A rebreather apparatus of the radial-type, comprising:

means for providing breathable gasses to a user of the apparatus and transporting gases exhaled by the user to a medium for removing unwanted elemental molecules from the exhaled gases;

means for providing compressed gases to the apparatus;

means for monitoring the gases circulating through the apparatus and controlling the addition of compressed gas to the apparatus;

a gas scrubber canister having at least one removable end cap and a cross sectional shape through a plane that is perpendicular to the longitudinal axis of the canister selected from the group of shapes consisting of an oval and an ellipse;

the at least one removable end cap being located at an end of the gas scrubber canister;

the at least one end cap configured for watertight attachment to the gas scrubber canister;

the gas scrubber canister configured for securing a disposable adsorbent material, used to remove unwanted elemental molecules from the exhaled gases, in the interior thereof;

the gas scrubber canister having a generally hollow interior tube located in the approximate center thereof, the tube having the same cross sectional shape through a plane that is perpendicular to the longitudinal axis of the tube as the gas scrubber canister and configured to allow gases to pass radially through the walls of the tube;

the gas scrubber canister being further configured such that when the adsorbent material is placed in the gas scrubber canister, there is a generally uniform space between the canister wall and the adsorbent material throughout the portion of the canister containing the adsorbent material such that gases will pass radially through the adsorbent material between the hollow tube and the space between the canister wall and the adsorbent material; and the apparatus further comprising a means for securing the apparatus to the body of a user of the apparatus.

2. The apparatus of claim 1 wherein the at least one removable end cap is configured for placing a gas monitoring and control system therein.

3. The apparatus of claim 2 wherein the at least one removable end cap is two end caps such that the scrubber canister has two removable end caps.

4. The apparatus of claim 3 wherein both removable end caps have a gas monitoring and control system inserted therein.

5. A rebreather apparatus of the radial-type, comprising:

a gas supply circuit having a mouthpiece, an inhalation potion, an exhalation portion and at least one counterlung;

the inhalation potion and the exhalation portion each having at least one gas conduit;

the mouthpiece being connected to the inhalation portion and the exhalation portion and configured to allow inhalation of gases from the inhalation portion and exhalation of gases into the exhalation portion;

a source of compressed gas;

the source of compressed gas being in communication with the gas supply circuit by at least one compressed gas conduit;

at least one control system for monitoring the gases circulating through the gas supply circuit and controlling the addition of compressed gas into the gas supply circuit;

a gas scrubber canister having at least one removable end cap;

a removable insert secured in the interior thereof such that there is a generally uniform space between the wall of the canister and the insert, and having a cross sectional shape through a plane that is perpendicular to the longitudinal axis of the insert selected from the group of shapes consisting of an oval and an ellipse;

the at least one removable end cap being located at an end of the gas scrubber canister;

the at least one removable end cap configured for watertight attachment to the gas scrubber canister and connection to the gas supply circuit via the gas conduits of the inhalation portion and the exhalation portion of the gas supply circuit;

the insert configured for holding a disposable adsorbent material used to remove unwanted elemental molecules from the gas supply conduit;

the insert having a generally hollow tube in the approximate center thereof and a plurality of holes therethrough to allow gases to pass through the insert and the adsorbent material;

the insert further configured such that when the insert is secured in the gas scrubber canister and filled with an adsorbent material and the at least one removable end cap is placed on the gas scrubber canister and connected to the gas supply circuit, gases will pass radially through the insert and adsorbent material between the hollow tube and the space between the canister wall and the insert;

the hollow tube having the same cross sectional shape through a plane that is perpendicular to the longitudinal axis of the tube as the insert; and the apparatus further comprising a harness for securing the apparatus to the body of a person using the apparatus.

6. The apparatus of claim 5 wherein the at least one removable end cap is configured for placing a gas monitoring and control system therein.

7. The apparatus of claim 6 wherein the at least one removable end cap is two end caps such that the scrubber canister has two removable end caps.

8. The apparatus of claim 7 wherein both removable end caps have a gas monitoring and control system inserted therein.

9. The apparatus of claim 5 wherein the apparatus is configured such that the gas scrubber canister is adapted to be worn on the back of a diver's body.

10. The apparatus of claim 9 wherein the long axis of the canister is adapted to be worn parallel with the long axis of the diver's body.

11. The apparatus of claim 5 wherein the apparatus is configured such that the gas scrubber canister is adapted to be worn on the front of a diver's body.

12. A rebreather apparatus of the radial-type, comprising:

a gas supply circuit having a mouthpiece, an inhalation potion, an exhalation portion and at least one counterlung;

a source of compressed gas that is in communication with the gas supply circuit through at least one compressed gas conduit;

at least one control system for monitoring the gases circulating through the gas supply circuit and controlling the addition of compressed gas into the gas supply circuit;

a gas scrubber canister having a pair of removable end caps, a removable insert secured in the interior thereof such that there is a generally uniform space between the wall of the canister and the insert, and a cross sectional shape through a plane that is perpendicular to the longitudinal axis of the canister selected from the group of shapes consisting of an oval and an ellipse;

the pair of removable end caps being located one at each end of the gas scrubber canister;

each end cap configured for watertight attachment of the gas scrubber canister and connection to the gas supply circuit via the gas conduits of the inhalation portion and the exhalation portion of the gas supply circuit;

each end cap being further configured such that the at least one automatic control system can be housed therein and the at least one compressed gas conduit can be connected thereto;

the insert configured for holding a disposable adsorbent material used to remove unwanted elemental molecules from the gas supply conduit;

the insert having a generally hollow tube in the approximate center thereof and a plurality of holes therethrough to allow gases to pass through the insert and the adsorbent material;

the insert further configured such that when the insert is secured in the gas scrubber canister and filled with an adsorbent material, and the end caps are placed on the gas scrubber canister and connected to the gas supply circuit, gases will pass radially through the insert and adsorbent material between the hollow tube and the space between the canister wall and the insert;

the insert and the hollow tube having the same cross sectional shape through a plane that is perpendicular to the longitudinal axis of the tube as the gas scrubber canister; and the apparatus further comprising a means for securing the apparatus to the body of a person using the apparatus.

13. The apparatus of claim 12 wherein removable end caps are configured for placing a gas monitoring and control system therein.

14. The apparatus of claim 13 wherein at least one of the removable end caps has a gas monitoring and control system inserted therein.

15. The apparatus of claim 12 wherein the ends caps have two flexible O-rings disposed thereon such that each O-ring creates an individual seal between the end caps and the scrubber canister, and the two O-rings create a watertight seal between the end caps and the scrubber canister.

16. The apparatus of claim 12 wherein the apparatus can be easily reconfigured such that the position that the gas scrubber canister and the compressed gas source are worn on the diver's body can be changed.

17. A rebreather apparatus of the radial-type, comprising:

(a) at least one tank for providing compressed breathing gases to the apparatus;

(b) an inhalation conduit for delivering breathing gases to a user;

(c) an exhalation conduit for receiving exhalation gases from the user; and (d) a gas scrubber including:

(i) a canister having an outer wall with a cross sectional shape through a plane that is perpendicular to the longitudinal axis of the canister selected from the group of shapes consisting of substantially oval and substantially elliptical;

(ii) an inlet to the canister;

(iii) an interior tube disposed within the canister, wherein the interior tube has a cross sectional shape through a plane that is perpendicular to the longitudinal axis of the interior tube substantially similar to the cross sectional shape of the canister;

(iv) a scrubbing material disposed within the canister in surrounding relationship with the interior tube, wherein exhalation gases travel in a substantially radial direction through the scrubbing material; and (v) an outlet from the canister.

18. The apparatus of claim 17 wherein the scrubbing material is spaced from the outer wall.

19. The apparatus of claim 17 wherein the inlet is configured such that gases are received along the inner surface of the outer wall.

20. The apparatus of claim 17 wherein exhalation gases travel from the inner surface of the outer wall, through the scrubbing material, and into the interior tube.

21. The apparatus of claim 17 wherein the inlet is configured such that gases are received in the inner tube.

22. The apparatus of claim 17 wherein exhalation gases travel from the inner tube, through the scrubbing material, and to the inner surface of the outer wall.

23. A gas scrubber for a rebreather apparatus of the radial-type, the gas scrubber comprising:

(a) a canister having an outer wall with a cross sectional shape through a plane that is perpendicular to the longitudinal axis of the canister selected from the group of shapes consisting of substantially oval and substantially elliptical;

(b) an inlet to the canister;

(c) an interior tube disposed within the canister, wherein the interior tube has a cross sectional shape through a plane that is perpendicular to the longitudinal axis of the interior tube selected from the group of shapes consisting of substantially oval and substantially elliptical;

(d) a scrubbing material disposed within the canister in surrounding relationship with the interior tube, wherein exhalation gases travel through the scrubbing material in a substantially radial direction; and (e) an outlet from the canister.

24. The gas scrubber of claim 23 wherein the scrubbing material is spaced from the outer wall.

25. The gas scrubber of claim 23 wherein the inlet is configured such that gases are received along the inner surface of the outer wall.

26. The gas scrubber of claim 23 wherein exhalation gases travel from the inner surface of the outer wall, through the scrubbing material, and into the interior tube.

27. The gas scrubber of claim 23, wherein the inlet is configured such that gases are received in the inner tube.

28. The gas scrubber of claim 23 wherein exhalation gases travel from the inner tube, through the scrubbing material, and to the inner surface of the outer wall.

* * * * *

UNITED STATES PATENT AND TRADEMARK OFFICE

CERTIFICATE OF CORRECTION

PATENT NO. : 7,520,280 B2
APPLICATION NO. : 10/821065
DATED : April 21, 2009
INVENTOR(S) : W. Gordon It is certified that error appears in the above-identified patent and that said Letters Patent is hereby corrected as shown below:

| COLUMN | LINE | ERROR |
|---|---|---|
| 7 | 37 | "potion," should read --portion,-- |
| (Claim 5, | line 3) | |
| 7 | 39 | "potion" should read --portion-- |
| (Claim 5, | line 5) | |
| 8 | 42 | "potion," should read --portion,-- |
| (Claim 12, | line 3) | |
| 9 | 27 | "ends caps" should read --end caps-- |
| (Claim 15, | line 1) | |

Signed and Sealed this

Twenty-second Day of September, 2009

David J. Kappos

David J. Kappos
*Director of the United States Patent and Trademark Office*